US010392892B2

(12) United States Patent
Lugo et al.

(10) Patent No.: US 10,392,892 B2
(45) Date of Patent: Aug. 27, 2019

(54) RAPID MOBILIZATION AIR-FREIGHTABLE CAPPING STACK SYSTEM

(71) Applicant: TRENDSETTER ENGINEERING, INC., Houston, TX (US)

(72) Inventors: Mario Lugo, Houston, TX (US); Noel Mascarenhas, Houston, TX (US); Michael Cargol, Houston, TX (US); Brett Morry, Houston, TX (US)

(73) Assignee: TRENDSETTER ENGINEERING, INC., Houston, TX (US)

( * ) Notice: Subject to any disclaimer, the term of this patent is extended or adjusted under 35 U.S.C. 154(b) by 155 days.

(21) Appl. No.: 15/597,362

(22) Filed: May 17, 2017

(65) Prior Publication Data

US 2017/0350210 A1 Dec. 7, 2017

Related U.S. Application Data

(60) Provisional application No. 62/344,185, filed on Jun. 1, 2016.

(51) Int. Cl.

| | |
|---|---|
| ***E21B 33/038*** | (2006.01) |
| ***E21B 33/064*** | (2006.01) |
| ***E21B 43/01*** | (2006.01) |
| ***E21B 33/06*** | (2006.01) |
| *E21B 21/10* | (2006.01) |
| *E21B 33/072* | (2006.01) |

(52) U.S. Cl.

CPC ..... *E21B 33/063* (2013.01); *E21B 33/038* (2013.01); *E21B 33/064* (2013.01); *E21B 43/0122* (2013.01); *E21B 21/106* (2013.01); *E21B 33/072* (2013.01)

(58) Field of Classification Search

CPC .... E21B 33/038; E21B 33/063; E21B 33/064; E21B 43/0122

See application file for complete search history.

(56) References Cited

U.S. PATENT DOCUMENTS

| | | | | |
|---|---|---|---|---|
| 4,324,505 | A | 4/1982 | Hammett | |
| 4,405,258 | A | 9/1983 | O'Rourke et al. | |
| 4,828,024 | A | 5/1989 | Roche | |
| 5,984,012 | A | 11/1999 | Wactor et al. | |
| 7,165,619 | B2 | 1/2007 | Fox et al. | |
| 7,597,811 | B2 | 10/2009 | Usher | |
| 7,921,917 | B2 | 4/2011 | Kotrla et al. | |
| 9,222,494 | B2 * | 12/2015 | Roach | E21B 33/03 |
| 9,416,797 | B2 * | 8/2016 | Van Wijk | E21B 33/06 |
| 2009/0095464 | A1 | 4/2009 | McGrath et al. | |

(Continued)

*Primary Examiner* — Matthew R Buck

(74) *Attorney, Agent, or Firm* — Egbert Law Offices, PLLC

(57) ABSTRACT

A method and apparatus for transporting a capping stack for use in a subsea structure includes a capping stack having a capping stack spool, a connector body connectable to the capping stack spool and at least one diverter leg connectable to the capping stack spool. A first skid receives the capping stack spool on a floor thereof. A second skid receives the connector body on a floor thereof. A third skid receives the diverter leg thereon. The first, second and third skids are adapted to be received within an interior of an aircraft. The skids and the connected components can then be flown by the aircraft to a desired location so as to be assembled at a location near a wellhead.

8 Claims, 6 Drawing Sheets

(56) References Cited

U.S. PATENT DOCUMENTS

| | | | | |
|---|---|---|---|---|
| 2009/0260829 | A1 | 10/2009 | Mathis | |
| 2012/0318521 | A1* | 12/2012 | Franklin | E21B 43/0122 166/363 |
| 2012/0318522 | A1* | 12/2012 | Franklin | E21B 43/0122 166/363 |
| 2013/0022401 | A1* | 1/2013 | Magowan | E21B 43/0122 405/60 |
| 2013/0299177 | A1* | 11/2013 | Lyle | E21B 33/064 166/338 |
| 2015/0060081 | A1* | 3/2015 | Cox | E21B 33/064 166/363 |

* cited by examiner

RAPID MOBILIZATION AIR-FREIGHTABLE CAPPING STACK SYSTEM

CROSS-REFERENCE TO RELATED APPLICATIONS

The present application claims priority from U.S. Provisional Patent Application Ser. No. 62/344,185, filed on Jun. 1, 2016, and entitled "Rapid Mobilization Air-Freightable Capping Stack System".

STATEMENT REGARDING FEDERALLY SPONSORED RESEARCH OR DEVELOPMENT

Not applicable.

NAMES OF THE PARTIES TO A JOINT RESEARCH AGREEMENT

Not applicable.

INCORPORATION-BY-REFERENCE OF MATERIALS SUBMITTED ON A COMPACT DISC

Not applicable.

BACKGROUND OF THE INVENTION

1. Field of the Invention

The present invention relates to blowout preventer systems for use with subsea wells. More particularly, the present invention relates to capping stacks as used in association with the wellhead or the blowout preventer. More particularly, the present invention relates to capping stacks that can be easily transported and assembled in a location adjacent to the wellhead. Furthermore, the present invention relates to capping stacks that can be deployed as air cargo to a desired location.

2. Description of Related Art Including Information Disclosed Under 37 CFR 1.97 and 37 CFR 1.98

As the worldwide demand for hydrocarbon fuel has increased, and known onshore reserves have not kept up with the demand, there has been increasing activity in offshore oil exploration and production. Reserves of oil known to exist in the offshore areas have steadily increased and an increasing percentage of world production is from these offshore areas. The offshore environment has presented numerous new challenges to the oil drilling industry which have been steadily overcome to allow efficient drilling and production in these areas, although the costs have been considerably higher than those of onshore operations.

Not only has the offshore environment made production more difficult to accomplish, it has also generally increased the risk of environmental damage in the event of a well blowout or other uncontrolled loss of hydrocarbons into the sea. As a result, known safety equipment, such as blowout preventers which have been used successfully in onshore operations, have been used in offshore operations also. In spite of safety precautions, blowouts of offshore oil wells are known to occur and will occur in the future.

Subsea drilling operations may experience a blowout, which is an uncontrolled flow of formation fluids into the drilling well. These blowouts are dangerous and costly, and can cause loss of life, pollution, damage to drilling equipment, and loss of well production. To prevent blowouts, blowout prevention equipment is required. This blowout prevention equipment typically includes a series of equipment capable of safely isolating and controlling the formation pressures and fluids at the drilling site. BOP functions include opening and closing hydraulically-operated pipe rams, annular seals, shear rams designed to cut the pipe, a series of remote-operated valves to allow control the flow of drilling fluids, and well re-entry equipment. In addition, process and condition monitoring devices complete the BOP system. The drilling industry refers to the BOP system as the BOP stack.

The well and the BOP connect the surface drilling vessel to a marine riser pipe, which carries formation fluids (e.g., oil, etc.) to the surface and circulates drilling fluids. The marine riser pipe connects to the BOP through the Lower Main Riser Package (LMRP) which contains a device to connect to the BOP, an annular seal for well control, and flow control devices to supply hydraulic fluids for the operation of the BOP. The LMRP and the BOP are commonly referred to, collectively, as simply the BOP. Many BOP functions are hydraulically controlled, with piping attached to the riser supplying hydraulic fluids and other well control fluids. Typically, a central control unit allows an operator to monitor and control the BOP functions from the surface. The central control unit includes a hydraulic control system for controlling the various BOP functions, each of which has various flow control components upstream of it.

While many of the techniques used in onshore operations can be applied in the offshore environment, they often prove to be less effective and require a much longer time period for implementation. For example, while relief wells can drilled to intercept the blowout well, a great amount of time may be required in the drilling operation. In drilling the relief wells, platforms or other drilling support decks must be located and transported to the blowout site before drilling operations can begin. Due to the rugged offshore environment, more time is required to drill the relief wells than would be required in onshore operations. As a result of all of these difficulties, many months can pass between the occurrence of an offshore oil well blowout and the successful final capping of the blown-out well. In the intervening time, large quantities of oil and gas can escape into the ocean with serious environmental impact.

While a portion of the hydrocarbons lost from a subsea well blowout may be trapped and skimmed by various containment booms and oil skimmer ships, substantial quantities of hydrocarbons can still escape such containment equipment. It can be seen that once the hydrocarbons are allowed to reach the ocean, surface wave action tends to disburse the lighter hydrocarbons which may mix with water or evaporate into the air. The gaseous hydrocarbons, of course, tend to escape into the atmosphere. The heavier ends of the crude oil often form into globules or tar balls which may flow at, or just below, the water's surface so as to make it difficult to contain or to skim up.

In the past, various patents and patent publications have issued relating to systems for the containment of oil spills and blowouts. For example, U.S. Pat. No. 4,324,505, issued on Apr. 13, 1982 to D. S. Hammett, discloses a subsea blowout containment method and apparatus. This blowout containment apparatus comprises an inverted funnel adapted for positioning over a wellhead to receive fluids from the well and direct them into a conduit extending from the funnel to surface support and processing equipment. The funnel and conduit are supported from the sea's surface, preferably by a vessel such as a barge. The barge carries the equipment to receive the full flow of fluids from the well, to process the fluids, and to conduct the liquids to a nearby tanker where the recovered liquid hydrocarbons may be stored.

U.S. Pat. No. 4,405,258, issued on Sep. 20, 1983 to O'Rourke et al., describes a method for containing oil and/or gas within a blow-out cover dome. This method includes the steps of deploying a containment dome in shallow water near the location of the seabed where the containment dome is to be located. The containment dome has an upper expanded dome-like fluid impervious membrane, a fluid impervious hollow peripheral ring attached to the periphery of the membrane to provide a depending bag-like container, and discrete water drainage means within the bag-like container for connection to pump conduit means therefrom. Wet sand from the seabed is then pumped into the bag-like container. Water is then drained from the wet sand through the water drainage means so as to provide a body of drained sand disposed within the bag-like container and providing a hollow peripheral ring as a hollow peripheral torus acting as a self-supporting structure and as an anchor for the dome-like structural unit. The dome is then charged with a buoyant amount of air and the buoyed dome is floated out to the site where the dome is to be deployed. It is then submerged by controllably releasing the air while substantially simultaneously filling the dome with water, thereby sinking the dome until the lighter-than-water fluid is captured within the dome.

U.S. Pat. No. 4,828,024, issued on May 9, 1989 to J. R. Roche, describes a diverter system and blowout preventer. The system comprises a blowout preventer attached above a spool having a hydraulically-driven sleeve/piston. An outlet flow passage exists in the spool. This outlet flow passage can be connected to a vent line. The outlet flow passage is closed off by the sleeve wall when the spool piston is at rest. Hydraulic ports are connected above and below the blowout preventer annular piston and above and below the spool annular piston. The ports below the blowout preventer piston and above the spool piston are in fluid communication with each other. A hydraulic circuit is provided having two valves between a source of pressurized hydraulic fluid and a drain.

U.S. Pat. No. 5,984,012, issued on Nov. 16, 1999 to Wactor et al., provides an emergency recovery system for use in a subsea environment. This emergency recovery system has a casing that is open at each end with a shackle connected to one end of the casing with the opposite end of the shackle designed for connection to appropriate points on the main stack and lower marine riser package in any orientation. A flexible sling with a closed loop formed at each end is used with one of the closed loops releasably connected to the shackle and the end of the casing. The other end of the sling has a flotation member attached to the sling adjacent the closed loop. The sling is fan folded as it is lowered into the casing. The flotation member is shaped to fit inside the other end of the casing with the closed end loop of the sling protruding from the casing. The flotation member is constructed of synthetic foam and is sized to provide sufficient buoyancy to fully extend the sling when the release ring is released by a remotely operated vehicle in a subsea environment.

U.S. Pat. No. 7,165,619, issued on Jan. 23, 2007 to Fox et al., teaches a subsea intervention system that includes a BOP module and CT module. A tool positioning system is used for positioning a selected subsea tool stored within a rack with a tool axis in line with the BOP axis, while a marinized coiled string injector is moved by positioning system to an inactive position. Power to the subsea electric motors is supplied by an electrical line umbilical extending from the surface for powering the pumps. An injector is provided that includes a pressure compensator roller bearing and a pressure-compensated drive system case.

U.S. Pat. No. 7,597,811, issued on Oct. 6, 2009 to D. Usher, provides a method and apparatus for subsurface oil recovery using a submersible unit. The submersible vehicle is positioned above the bed of a diver supported on a platform above the pollutant. A wand at one end of a pipe evacuated by a centrifugal pump is manipulated to draw the pollutant to the surface for treatment or disposal.

U.S. Pat. No. 7,921,917, issued on Apr. 12, 2011 to Kotrla et al., shows a multi-deployable subsea stack system. This subsea stack system includes a lower marine riser package, a blowout preventer stack with a first ram blowout preventer, and an additional blowout preventer package releasably coupled to the blowout preventer stack and comprising a second ram blowout preventer. The subsea blowout preventer stack assembly can be deployed by coupling a drilling riser to the lower marine riser package that is releasably connected to the blowout preventer stack. The lower marine riser package and blowout preventer stack are then attached to a subsea wellhead and then landed on the additional blowout preventer package that is coupled to the subsea wellhead.

U.S. Patent Publication No. 2009/0095464, published on Apr. 16, 2009 to McGrath et al., provides a system and method for providing additional blowout preventer control redundancy. This system has backup or alternate fluid flow routes around malfunctioning BOP control components using a remotely-installed removable hydraulic hose connection. The backup fluid flow route sends pressure-regulated hydraulic fluid to a BOP operation via an isolation valve rigidly attached to the BOP, then to a hose connected to an intervention panel on the BOP, and finally through a valve that isolates the primary flow route and establishes a secondary flow route to allow continued operation.

U.S. Patent Publication No. 2009/0260829, published on Oct. 22, 2009 to D. J. Mathis, provides a subsea tree safety control system that limits the probability of failure on demand of a subsea test tree. A safety shut-in system is provided for actuating a safety valve of the subsea test tree. The safety shut-in system includes a surface control station positioned above a water surface connected via an umbilical to a subsea control system positioned below the water surface so as to actuate the safety valve.

U.S. patent application Ser. No. 13/160,032, filed on Jun. 14, 2011 to the present assignee, discloses a diverter system for a subsea well. This diverter system is commonly known as a "capping stack". This diverter system includes a body having a flow passageway extending therethrough, a ram affixed to the body and extending in transverse relationship to the flow passageway, at least one channel in fluid communication with the flow passageway so as to allow fluid in the flow passageway to pass outwardly of the body, and at least one flowline in valved communication with the flow passageway of the body so as to selectively allow a fluid to be introduced into the flow passageway. The body has an inlet end and an outlet end. The inlet end is suitable for application to an outlet of a blowout preventer. The ram is actuatable so as to change a flow rate of fluid passing through the flow passageway. The channel includes a first channel in valved communication with the flow passageway and a second channel in valved communication with the flow passageway. Each of these channels extend in transverse relationship to the flow passageway so as to pass fluid from the flow passageway to a location away from the body.

The product that is sold by Trendsetter Engineering, Inc. that is the subject of U.S. application Ser. No. 13/160,032 has been a highly successful product for the company. This product is relatively heavy and has a weight in the order of between 100 to 150 tons. Since the flow diverter sends the fluid flow in perpendicular relationship to the flow from the blowout preventer, there is a possibility of erosion to the internal components of the capping stack when the fluid flows at very high rates. The single centralized bore is limited by the available valve/ram sizes. In this product, the central bore extends entirely through the body of the capping stack. As such, in order to install the capping stack, the central bore remains open during installation. As such, the fluid flowing from the blowout preventer will pass freely through the central bore of the capping stack during installation. Once the product is installed on the blowout preventer, the central bore is closed by rams (in the nature of a blowout preventer) so as to stop the flow through the central bore of the capping stack. At that time, the channels can be either closed so as to retain the flow of fluids in the well or open so as to allow the fluids to be removed from the capping stack.

After extended use of the invention of this publication, it was found that it would be desirable to significantly reduce the weight of the capping stack. The weight of the capping stack requires that the capping stack be assembled on location. Very few airplanes have the capacity to carry the entire assembled capping stack to the desired location. The relatively large size of the this capping stack can be somewhat difficult to maneuver between the risers of tension leg platforms or spar platforms. Additionally, although the capping stack is within the limits of cranes associated with offshore platforms, it does require the maximum capacity of such equipment. Since the capping stack is required to be assembled at the location, additional testing is required once the capping stack is reassembled. Although the capping stack is very heavy, the actual weight of the capping stack is of no particular value for the closing or control of the well.

So as to address the issue of the significant weight of the capping stack, the present applicant developed the subject of U.S. Patent Publication No. 2015/0060081, published on Mar. 5, 2015. In particular, this publication shows a capping stack for use with a subsea well that has a body with a flow passageway extending therethrough, a first bore having one end opening to an outlet end of the flow passageway, a second bore opening to the outlet end of the flow passageway, a first flow line affixed to the first bore and extending upwardly therefrom, a second flow line affixed to the second bore extending upwardly therefrom, a first valve cooperative at the first flow line so as to be movable between an open position and a closed position, and a second valve cooperative at the second flow line so as to be movable between an open position and a closed position. The inlet end of the flow passageway is suitable for connection to a blowout preventer or to a wellhead of a subsea well. Each of the bores extends upwardly at an acute angle to vertical from the flow passageway.

Since many offshore blowouts are located a significant distance away from the manufacturer of such capping stacks, it is important to be able to transport the capping stack rapidly to the location of the blowout. This is particularly true since deepwater exploration activities pushing to more remote and environmentally-sensitive areas of the world. As such, the desire for a rapid response subsea capping system becomes amplified. Although there are existing capping stack systems staged in strategic locations around the world, regulatory expectations of timely response have not been met with these existing options. As such, a need as the developed to provide such a capping stack that can be relatively immediately mobilized to any point in the world with suitable aircraft landing facilities in a period of not less than 96 hours.

It is object of the present invention to provide a capping stack system that can rapidly respond to emergency conditions.

It is another object of the present invention to provide a capping stack system that is transportable with a 747-400 cargo aircraft.

It is another object of the present invention to provide a capping stack system that requires minimal reassembly at an incident staging location.

It is another object of the present invention to provide a capping stack system that is capable of isolating pressures up to 15,000 p.s.i.

It is another object of the present invention to provide a capping stack system that is installable in an incident well at depths of up to 10,000 feet.

It is another object of the present invention provide a capping stack system that is installable on an incident well with a maximum discharge rate of up to 100,000 barrels of oil per day and a gas/oil ratio of 2000.

It is another object of the present invention to provide a capping stack system that provides the primary well isolation and provides functionality to serve as the mechanical connector point for flow back operations.

It is another object of the present invention provide a capping stack system to provide center bore access.

It is another object of the present invention to provide a capping stack system that is adapted for regulatory compliant transport on roads, air and water.

It is still further object of the present invention to provide a capping stack system that is movable by a forklift, a crane or a scissor-lift.

These and other objects and advantages of the present invention will become apparent from a reading of the attached specification and appended claims.

BRIEF SUMMARY OF THE INVENTION

The present invention is an apparatus that comprises a capping stack having a capping stack spool and a connector body connectable to the capping stack spool. The capping stack has at least one diverter leg that is connectable to the capping stack spool. A first skid receives the capping stack spool on a floor thereof. A second skid receives the connector body on a floor thereof. The third skid receives the diverter leg on a floor thereof. The first, second and third skids, along with the capping stack spool, the diverter leg and the connector body are adapted to be received within an interior of an aircraft.

At least one of the first, second and third skids has a plurality of sidewalls extending upwardly from the floor of the skids. Each of the sidewalls is positioned at respective corners of the floor of the skid. The capping stack spool is bolted to the floor of the first skid. The connector body is bolted to the floor of the second skid. The diverter leg is bolted to the floor of the third skid. The floors of the skids each have a pair of opposite ends and a pair of opposite sides extending between the pair of opposite ends. The skid has handles affixed to and extending upwardly respectively from the pair of opposite ends and the pair of opposite sides. The skids also have a top surface and a bottom surface in spaced parallel relation to each other. The skid has a pair of fork-receiving slots formed between the top surface and the bottom surface.

The capping stack has a test stump connectable to the bottom of the connector body. The apparatus further includes a fourth skid that receives the test stump on a floor thereof. The diverter leg includes first, second and third diverter legs. The first skid includes a plurality of skids having floors respectively receiving the first, second and third diverter legs. In the present invention, there is a first container that receives the first skid and the received capping stack spool therein. A second container receives the second skid and the received at least one diverter leg therein. A third container receives the third skid and the received connector body therein. In the present invention, an aircraft is provided that has a cargo bay therein. The first, second and third containers are received in the cargo bay. The capping stack spool is removably affixed to the floor of the first skid. The diverter leg is removably affixed to the floor of the second skid. The connector body is removably affixed to the floor of the third skid. The capping stack also includes a running tool. This running tool is removably affixed to the floor of the first skid.

The present invention is also a method for transporting a capping stack for use on a subsea structure. The capping stack includes a capping stack spool, at least one diverter leg, and a connector body. The method includes the steps of: (1) affixing the capping stack spool onto a first skid; (2) affixing the diverter leg onto a second skid; (3) affixing the connector body onto a third skid; (4) moving the first, second and third skids with the affixed capping stack spool, the diverter leg, and the connector body into the cargo bay of an aircraft; (5) flying the aircraft to a desired location; (5) removing the first, second and third skids and the affixed capping stack spool, diverter leg and connector body from the cargo bay of the aircraft; (6) transporting the first, second and third skids with the affixed capping stack spool, diverter leg, and connector body to a wellhead location; (7) removing the capping stack spool, the diverter leg and the connector body from the first, second and third skids; (8) assembling the diverter leg and the connector body to the capping stack spool so as to form the capping stack; and (9) affixing the assembled capping stack to the subsea structure.

In this method, the capping stack has a test stump. The method further includes affixing the test stump to a fourth skid, and moving the fourth skid and the affixed test stump the cargo bay of the aircraft. The diverter leg includes a first diverter leg and a second diverter leg. The second skid includes a pair of second skids. The method further includes affixing the first diverter leg to one of the pair of second skids and affixing the second diverter leg to the other of the pair of second skids.

In this method, the skids have a fork-receiving slots formed therein. The step of moving includes engaging forks of a forklift into the fork-receiving slots of the skids then and moving the forklift toward the cargo bay of the aircraft. The step of transporting includes placing the first, second and third skids and the affixed capping stack spool, diverter leg and connector body onto a boat. The steps of removing and assembling occurring on the boat.

The method of the present invention also can include positioning the first, second and third skids and the affixed capping stack spool, diverter leg and connector body into respective first, second and third containers. The first, second and third containers are then moved so as to be placed into the cargo bay of the aircraft. The first, second and third skids, along with the affixed capping stack spool, the diverter leg, and the connector body can be placed on respective trucks. These trucks can be driven to the aircraft.

In the method of the present invention, the capping stack components are transported by a truck to the aircraft. Each of the separate skids, along with the attached components, is moved from the trucks into the cargo bay of a large aircraft. Each of the skids, along with the associated components, can be suitably stacked upon each other and arranged within the cargo bay. The aircraft can then fly to an airport near an incident well. The skids, along with the attached components, are unloaded from the cargo bay of the aircraft and moved to a boat or assembled at the aircraft landing location and then placed on the boat. The boat can then travel to the incident well. The assembled capping stack is lowered from the boat onto the well and secured to the wellhead, to a blowout preventer, or to an adapter body.

Since each of the components has a weight of less than 30 tons, they are adapted for transport on roadways and are in compliance with regulatory transport requirements. As such, each of the components can be easily lifted and manipulated by a forklift, a crane, or by a scissor lift. Ultimately, the assembly can be carried out in a timely and efficient manner.

When an incident is reported, each of the skids, along with the attached components, can be immediately transported to the incident location. Standard equipment can be utilized for securing each of the components together prior to the placement of the capping stack on the well.

The foregoing Section is intended to describe, with particularity, the preferred embodiment of the present invention. It is understood that modifications to this preferred embodiment can be made within the scope of the present invention. As such, this Section should not to be construed, in any way, as limiting of the scope of the present invention. The present invention should only be limited by the following claims and their legal equivalents.

DETAILED DESCRIPTION OF THE INVENTION

Figure 1:
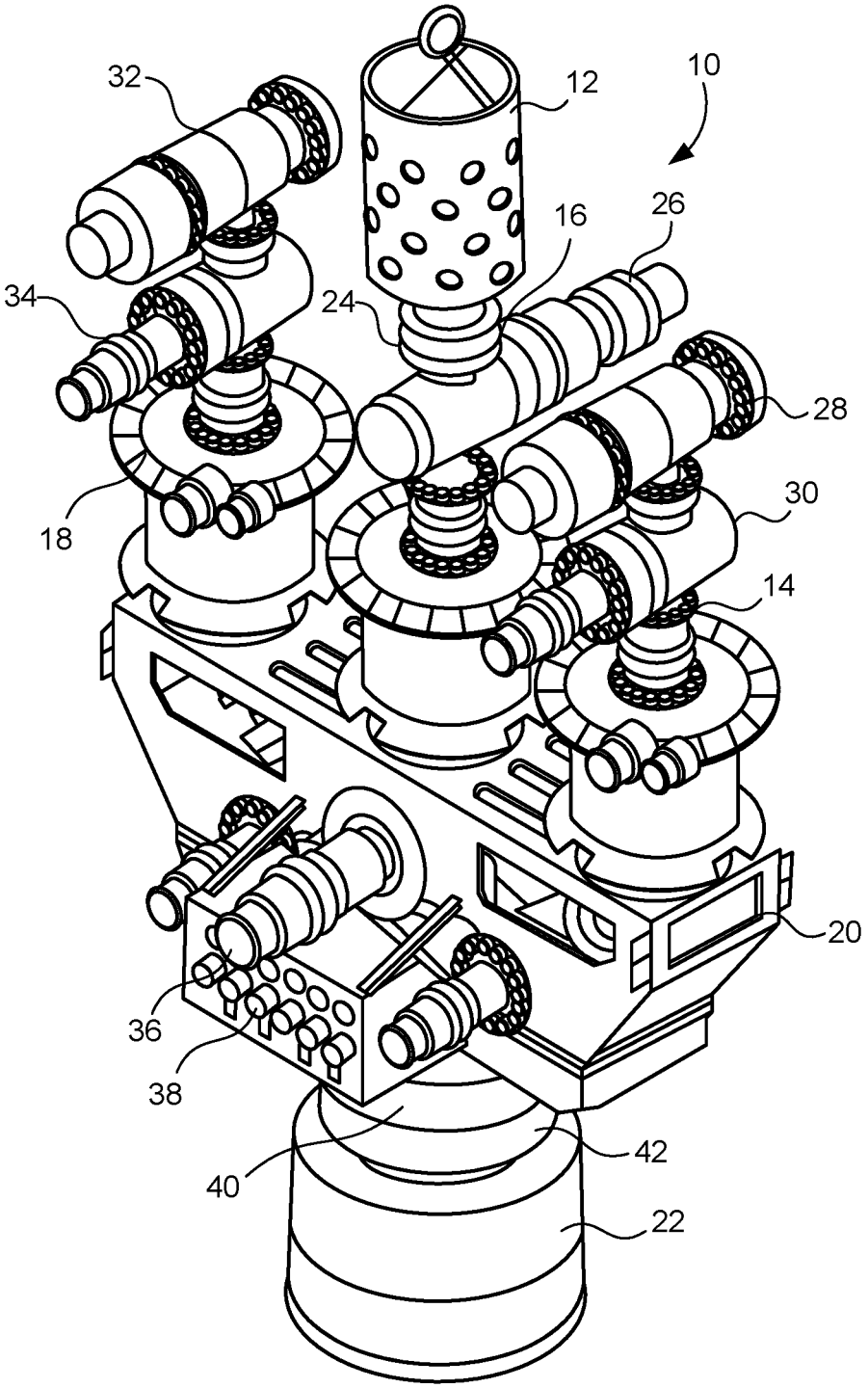
FIG. 1 is a perspective view of the assembled capping stack in accordance with the teachings of the present invention.

FIG. 1 shows a capping stack 10 in accordance with the teachings of the present invention. The capping stack 10 is similar to that described in prior U.S. Patent Application Publication Nos. 2012/0318520 and 2015/0060081 to the present applicant. In particular, the capping stack 10 includes a running tool 12, a plurality of diverter legs 14, 16 and 18, a capping stack spool 20, and a connector body 22. The running tool 10 is affixed to an outboard connector 24 of one of the diverter legs 16. A subsea retrievable isolation valve 26 is also connected to the diverter legs 16. The diverter legs 14 includes a choke 28 at the upper end thereof and a valve 30. The valve 30 is adapted to be manipulated by an ROV. The diverter legs 16 also include a choke 32 at an upper end thereof and an ROV-manipulatable valve 34 thereon. Each of the diverter legs 14, 16 and 18 has an interior passageway through which the flow of hydrocarbons can pass for the purposes of diversion.

The capping stack spool 20 includes a central passageway (not shown) that can be opened and closed by a valve 36. The closing of the valve 36 allows the hydrocarbons to flow outwardly through the diverter legs 14 and 18. Also, the opening of the valve 36 allows a pass through of the fluid flow through the diverter leg 16. As such, and was described in these prior U.S. Patent Application Publications, when the capping stack 10 is installed upon a blowout preventer or a wellhead, the central diverter leg 16 is open so as to allow a free flow of the hydrocarbons therethrough. Ultimately, once the connector 22 is properly installed on the wellhead or the blowout preventer, the valve 36 can be manipulated so as to diverge the flow of hydrocarbons through each of the diverter legs 14 and 18. The capping stack spool 20 also includes a ROV control panel 38 thereon. Ultimately, the capping stack spool 20 includes a lower connector 40 that is adapted to be connected to an upper connector 42 of connector body 22.

Figure 2:
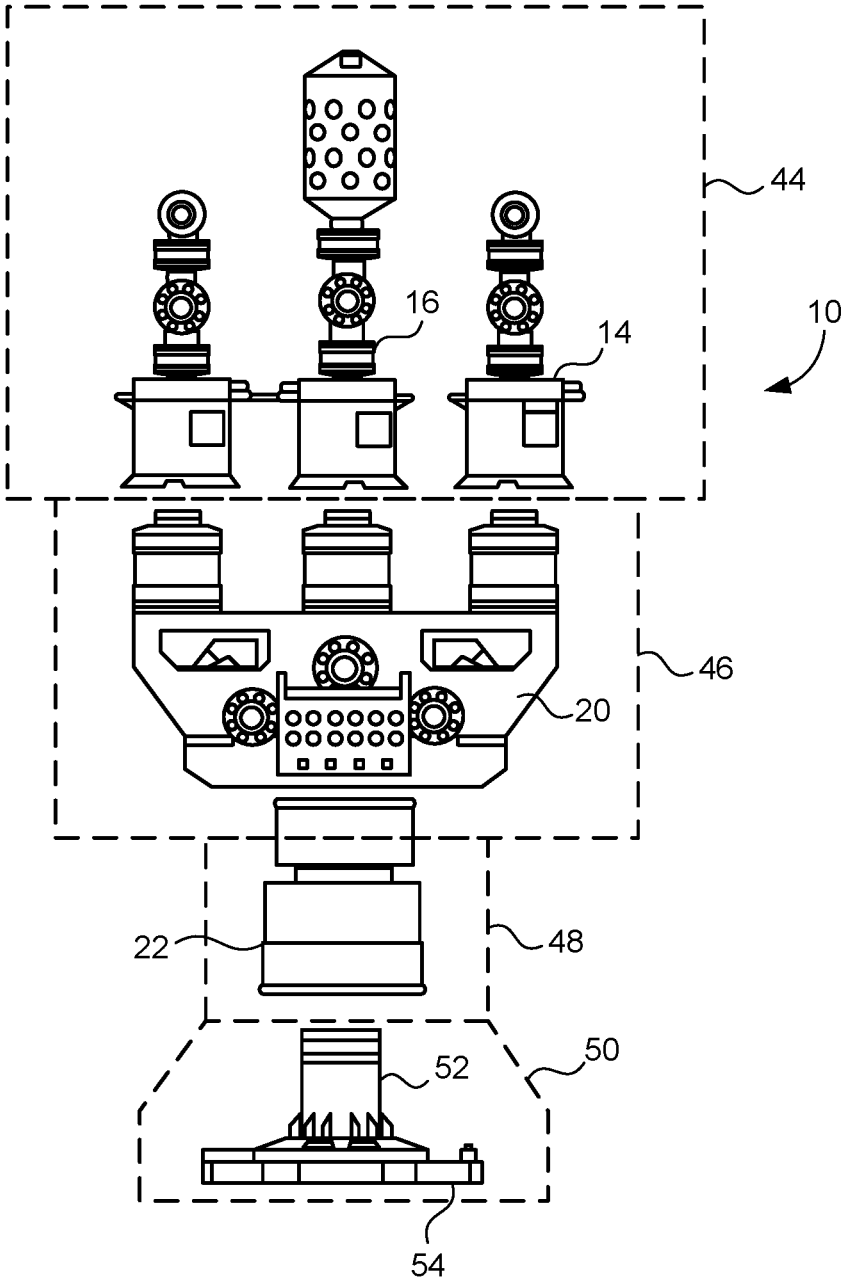
FIG. 2 is a side elevational view showing the components of the capping stack of the present invention as modularized for transport.

FIG. 2 shows each of the components of the capping stack 10 as isolated in the separate modules. In particular, there is a module 44 receiving the diverter leg 14, the diverter leg 16, and the diverter leg 18. The module 46 receives the capping stack spool 20 therein. The module 48 receives the connector body 22 therein. Ultimately, the module 50 includes a test stump 52 therein. Test stump 52 includes a portion that can be threadedly received within the connector body 22. The test stump 52 can be mounted upon a pad 54.

Figure 3:
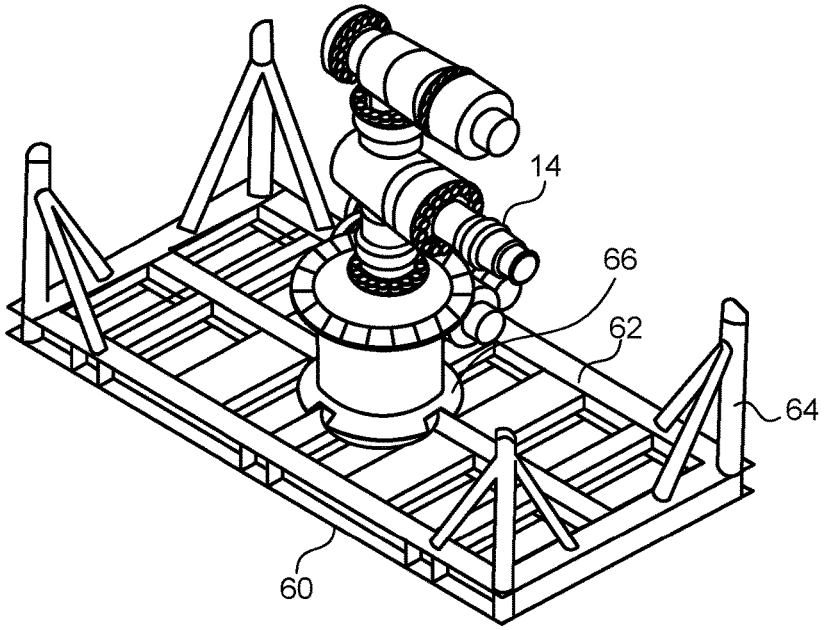
FIG. 3 is a perspective view showing one of the diverter legs of capping stack of the present invention as placed on a skid.
Figure 4:
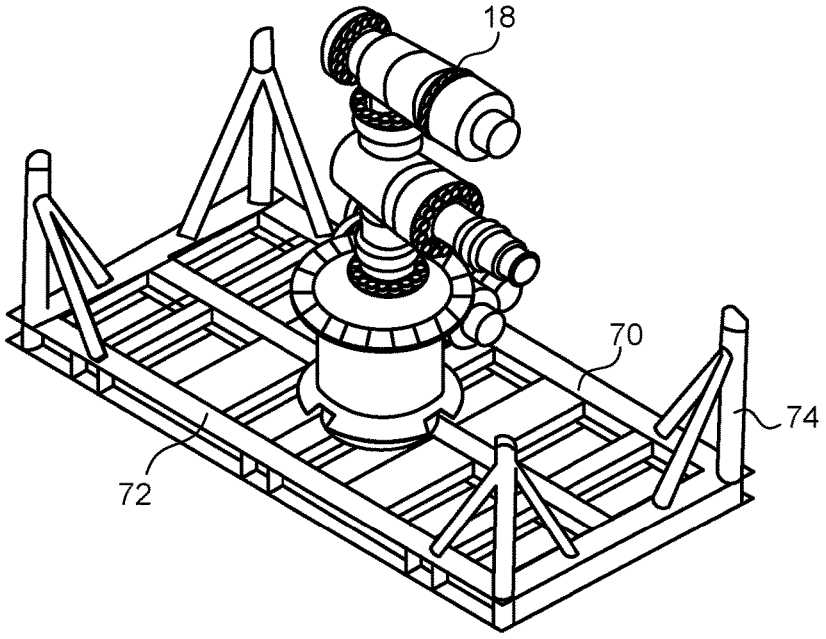
FIG. 4 is a perspective view showing another of the diverter legs of the capping stack of the present invention as placed upon a skid.

Within the concept of the present invention, it is important to separate the various components of the capping stack into an air-freightable and stackable arrangement. FIG. 3 shows, in particular, the diverter leg 14 as mounted upon a skid 60. The skid 60 includes a floor 62 and sidewalls 64. As such, the diverter leg 14 will be contained within the skid 60 and protected from damage by the sidewalls 64. In particular, the bottom connector 66 will be rigidly affixed to the floor 62 of the skid 60. FIG. 4 shows the diverter leg 80 as mounted upon a skid 70. Skid 70 includes a floor 72 and sidewalls 74. As will be described hereinafter, each of the skids described herein can include suitable slots for receiving the forks of a forklift. Other structures can be provided on each of the skid so as to allow the skids to be manipulated by a crane or by a scissor lift.

Figure 5:
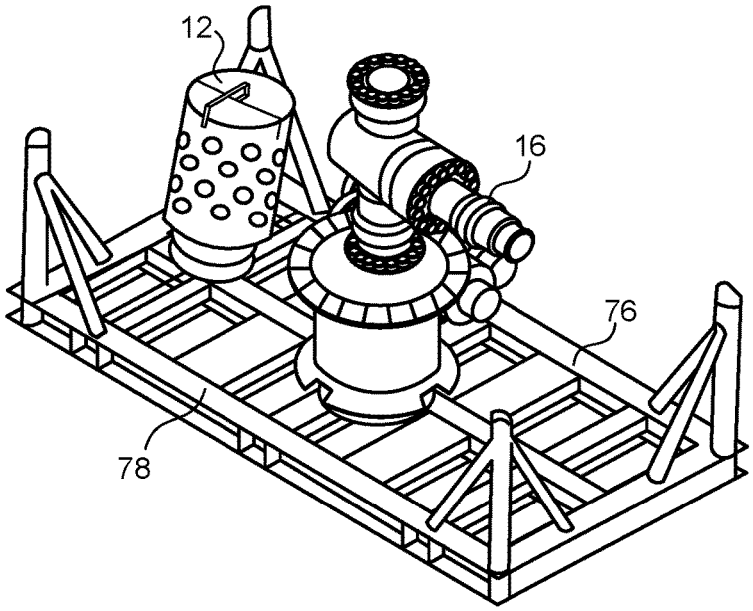
FIG. 5 is a perspective view showing another of the diverter legs and the running tool of the capping stack of the present invention as placed upon a skid.

FIG. 5 shows the center diverter leg 16 as affixed onto a skid 76. Also, the running tool 12 is also mounted upon the floor 78 of the skid 76.

Figure 6:
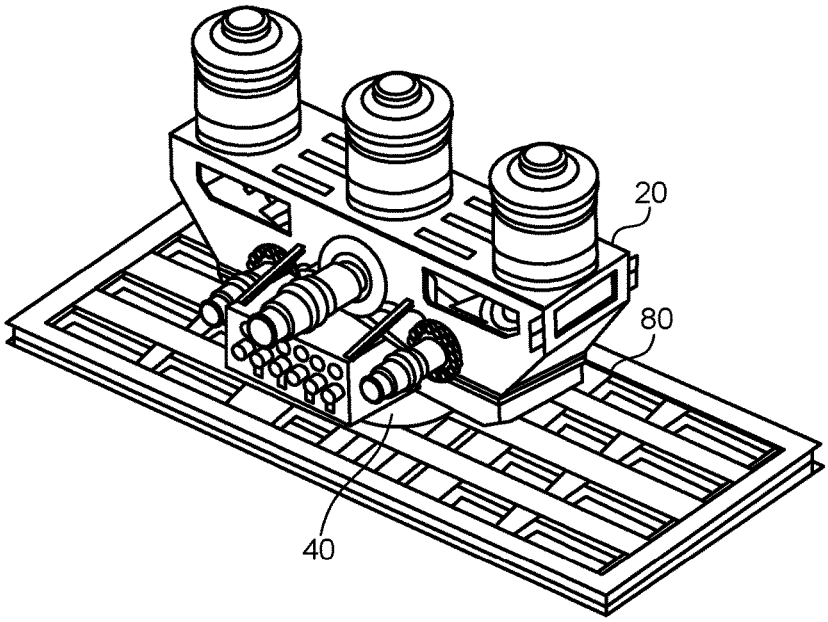
FIG. 6 is a perspective view showing the capping stack spool of the capping stack of the present invention as placed upon a skid.

FIG. 6 shows the capping stack spool 20 mounted upon the skid 80. In particular, the lower connector 40 of the capping stack spool 20 is securely affixed onto the skid 80.

Figure 7:
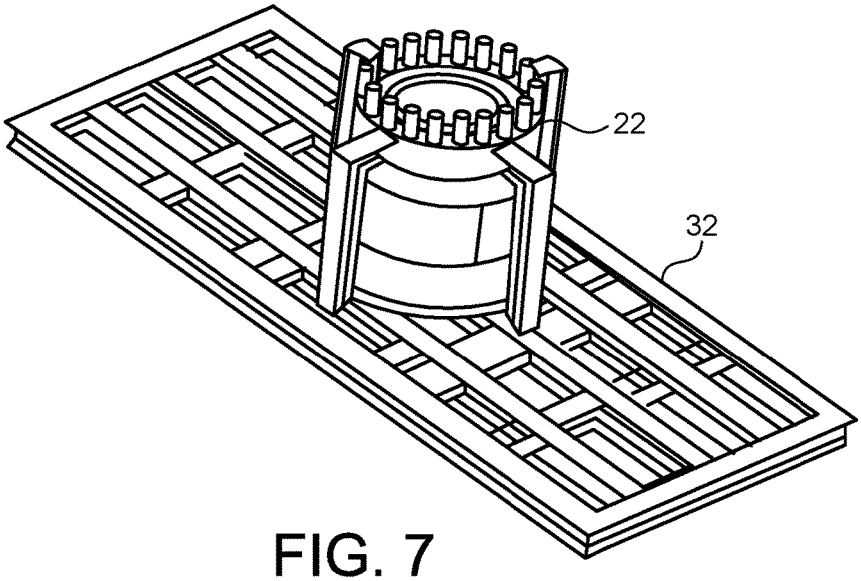
FIG. 7 is a perspective view showing the connector body of the capping stack of the present invention as placed upon a skid.

FIG. 7 shows the connector body 22 affixed to the skid 82. Although the walls associated with each of the skid 60, 70, 76, 80 and 82 is omitted for clarity, each of the walls will extend upwardly on each of the sides of the respective skids. If desired, a cover or roof can be provided over each of the components on the separate skids.

Figure 8:
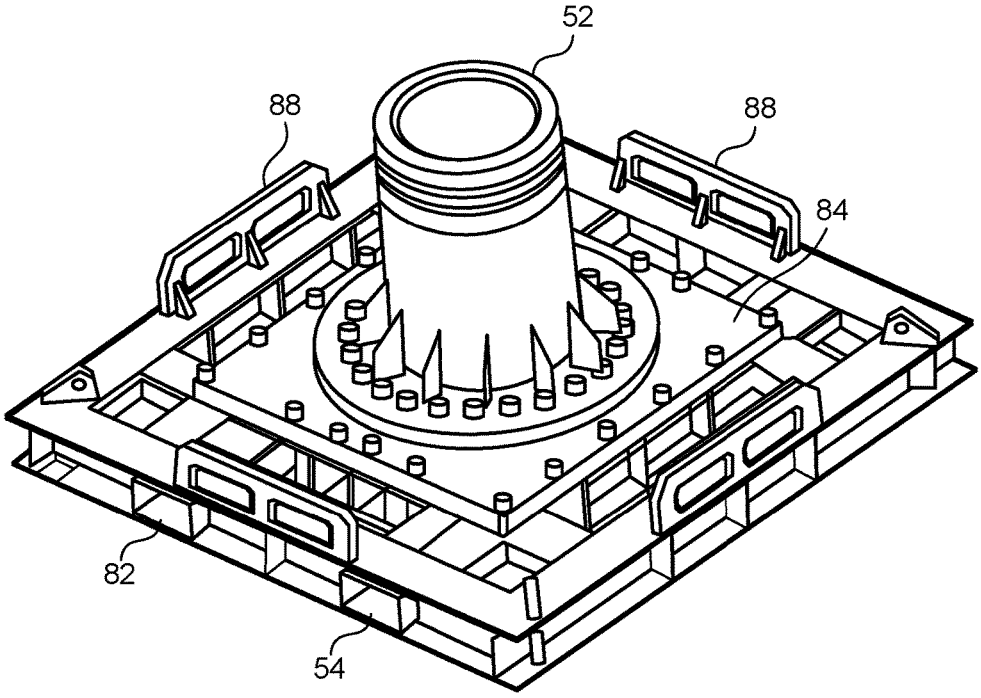
FIG. 8 is a perspective view showing the test stump as used in the capping stack of the present invention.

FIG. 8 shows the test stump 52 as mounted upon a test stand 84 and also mounted upon a transport skid 54. In particular, FIG. 8 shows that there are fork-receiving slots 86 formed in the transport skid 54. As such, a suitable forklift can easily transport the test stump 52. Additionally, handles 88 can extend upwardly from the transport skid 54. Handles 88 can be utilized in association with lines or other grasping devices so as to effectively lift the test stump 52.

Figure 9:
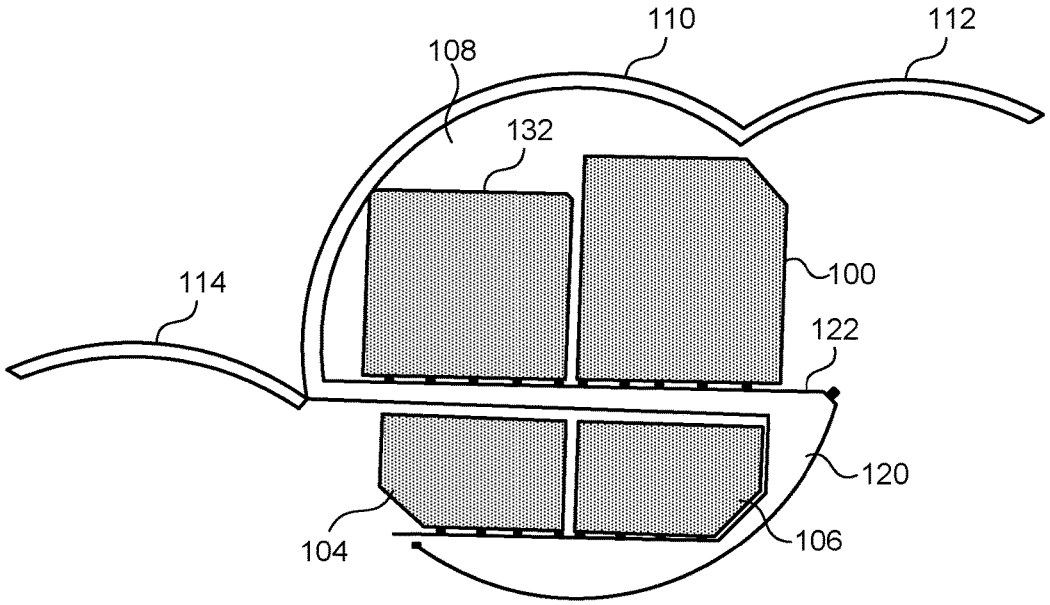
FIG. 9 is a cross-sectional view of a Boeing 747-400 aircraft having the various components loaded therein.

FIG. 9 illustrates that the various containers 100, 102, 104 and 106 can be placed within the cargo bay 108 of a 747 aircraft 110. Doors 112 and 114 can open to the cargo bay 108 so as to allow the containers 100, 102, 104 and 106 to be introduced therein. In particular, door 114 can be open so as to allow the containers 104 and 106 to be introduced into the lower portion 120 of the cargo bay 108. Additionally, the door 112 can be open so as to allow containers 100 and 102 to be placed upon the floor 122 within the cargo bay 108 of the aircraft 110.

Figure 10:
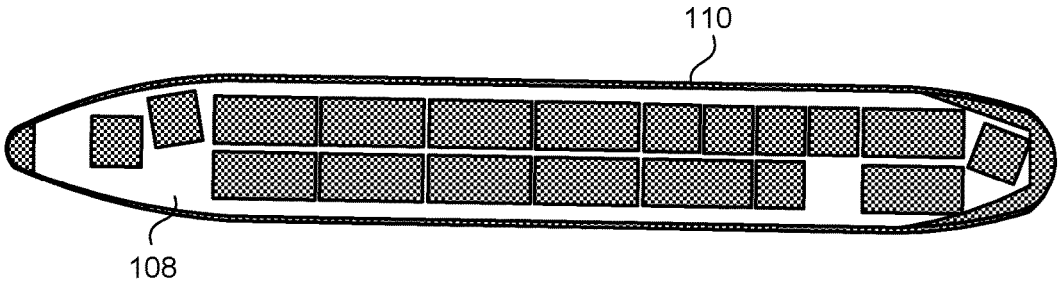
FIG. 10 is a cross-sectional plan view showing the arrangement of the various skids within the cargo bay of the 747 aircraft.

FIG. 10 shows the interior of the aircraft 110 in which a variety of containers are placed within the cargo bay 108. In particular, in FIG. 10, all of the components necessary for the assembly of the completed capping stack can be placed therein for the purposes of rapid deployment.

The capping stack system herein allows for rapid deployment to incident locations around the world. In particular, the capping stack system can be stored at a single location and delivered by suitable aircraft to the facilities in a period of less than 96 hours. As such, the capping stack system of the present invention is adapted to satisfy rapid response requirements.

The capping stack system described herein is suitable for the isolation of pressure to a maximum of 15,000 p.s.i. It can be installed in an incident well in water depths up to 10,000 feet. Additionally, it is suitable for installation on an incident well with a maximum discharge rate of up to 100,000 barrels of oil per day with a gas/oil ratio of 2000. The capping stack system provides primary well isolation (i.e. capping) and provides functionality to service the mechanical connection point for flow back (i.e. containment) operations if required for well integrity concerns. The capping stack system of the present invention adheres to the dual mechanical barrier philosophy for all functional barriers. The capping stack system of the present invention also provides center bore access for open water invention operations post-kill.

For ground transportation, the weight loads provided by the separate modules and skids of the present invention allows for DOT compliance for loads. The total weight transported by the various skids is designed to accommodate loading, transit and unloading on a Boeing 747-400 aircraft. The various components and/or the assembled capping stack are designed for lashing and marine transport to the incident site fully assembled by a marine deployment vessel.

In the present invention, the capping stack spool 20 provides two main functions. First it facilitates capping stack installation by providing a flow path for the hydrocarbon flow stream while the vertical flow is restricted or shut-off. Secondly, it provides multiple connection points for the containment/collection system should total capping/sealing of the flow not be possible. The individual gate valves are used to provide a barrier against flow on each of the diverter legs. Two gate valves are installed on each diverter leg for double isolation against flow. The chokes that are installed on each diverter leg are used to restrict flow in a shut-in situation to help gain control of a flowing well and minimize any hammer effects caused by restricting the flow too quickly. Once the flow has been restricted to a minimum, the gate valves are then employed to close the diverter leg and isolate the flow. Each of the chokes can be manually operated by way of a torque tool associated with a ROV. All of the subsea components are arranged to be visible for inspection and provided with suitable markings to aid in identification. The capping stack system is fitted with ROV grab handles to support alignment and installation. The grab panels are located so as to not to impede the connection of any of the components.

The capping stack system of the present invention is capable of being installed via conventional wireline rigging arrangements. The capping stack system contains all necessary handling and testing tools.

To be deployed to a drilling rig, the capping stack system will be compliant with various requirements: (1) to have a lifting frame or point to be handled by an offshore cranes; (2) to have a dedicated test stump; (3) to be handled modularly if the overall weight of the capping stack is heavier than thirty tons; and (4) to be capable of being re-connected and tested offshore by quick connectors. Each of the remaining equipment will have a lifting frame, a designated offshore storage container, or a point to be handled by an offshore crane.

The foregoing disclosure and description of the invention is illustrative and explanatory thereof. Various changes in the details of the illustrated construction or in the steps of the described method can be made within the scope of the present claims without departing from the true spirit of the present invention. The present invention should only be limited by the following claims and their legal equivalents.

We claim:

1. A method for transporting a capping stack for use in a subsea structure, the capping stack having a capping stack spool, at least one diverter leg, and a connector body, the method comprising:

affixing the capping stack spool onto a first skid;

affixing the at least one diverter leg onto a second skid;

affixing the connector body onto a third skid;

moving the first, second and third skids with the affixed capping stack spool, the affixed at least one diverter leg, and the affixed connector body into a cargo bay of an aircraft;

flying the aircraft to a desired location;

removing the first, second and third skids with the affixed capping stack spool, the affixed at least one diverter leg and the affixed connector body from the cargo bay of the aircraft;

transporting the first, second and third skids with the affixed capping stack spool, the affixed at least one diverter leg, and the affixed connector body to a well-head location;

removing the capping stack spool, the at least one diverter leg and the connector body from the respective first, second and third skids;

assembling the at least one diverter leg and the connector body to the capping stack spool so as to form the capping stack;

lowering the assembled capping stack to the subsea structure; and affixing the assembled capping stack to the subsea structure.

2. The method of claim 1, the capping stack having a test stump, the method further comprising:

affixing the test stump to a fourth skid; and moving the fourth skid and the affixed test stump to the cargo bay of the aircraft.

3. The method of claim 1, the at least one diverter leg having a first diverter leg and a second diverter leg, said second skid comprising a pair of second skids, the method further comprising:

affixing the first diverter leg to one of said pair of second skids; and affixing the second diverter leg to another of said pair of second skids.

4. The method of claim 1, each skid having fork-receiving slots formed therein, the step of moving comprising:

engaging forks of a forklift into the fork-receiving slots of each skid; and moving the forklift toward the cargo bay of the aircraft.

5. The method of claim 1, the step of transporting comprising:

placing the first, second and third skids with the affixed capping stack spool, the affixed diverter leg and the affixed connector body onto a boat, the steps of removing and assembling occurring on the boat.

6. The method of claim 1, further comprising:

positioning the first, second and third skids with the affixed capping stack spool, the affixed diverter leg, and the affixed connector body into respective first, second and third containers.

7. The method of claim 6, the step of moving comprising:

moving the first, second and third containers into the cargo bay of the aircraft.

8. The method of claim 1, the step of moving comprising:

positioning the first, second and third skids with the affixed capping stack spool, the affixed diverter leg, and the affixed connector body on respective trucks; and driving the trucks to the aircraft.

* * * * *